US009454862B2

(12) United States Patent
Seroka et al.

(10) Patent No.: US 9,454,862 B2
(45) Date of Patent: Sep. 27, 2016

(54) CASH BOX HAVING A MOVABLE BASE TRAY

(71) Applicant: WINCOR NIXDORF INTERNATIONAL GMBH, Paderborn (DE)

(72) Inventors: Karl-Heinz Seroka, Salzkotten (DE); Martin Landwehr, Paderborn (DE)

(73) Assignee: WINCOR NIXDORF INTERNATIONAL GMBH (DE)

( * ) Notice: Subject to any disclaimer, the term of this patent is extended or adjusted under 35 U.S.C. 154(b) by 0 days.

(21) Appl. No.: 14/789,192

(22) Filed: Jul. 1, 2015

(65) Prior Publication Data

US 2016/0005254 A1 Jan. 7, 2016

(30) Foreign Application Priority Data

Jul. 4, 2014 (EP) ..... 14175768

(51) Int. Cl.
*G07D 13/00* (2006.01)
*G07D 11/00* (2006.01)
*B65H 1/02* (2006.01)

(52) U.S. Cl.
CPC ..... *G07D 11/0006* (2013.01); *G07D 11/0012* (2013.01); *G07D 11/0018* (2013.01); *B65H 1/025* (2013.01)

(58) Field of Classification Search
CPC ..... B65H 1/02; B65H 1/025; B65H 1/027; B65H 1/14; G07D 11/0006; G07D 11/0012; G07D 11/0018
USPC ..... 194/351
See application file for complete search history.

(56) References Cited

U.S. PATENT DOCUMENTS

| | | | | |
|---|---|---|---|---|
| 4,809,966 | A | 3/1989 | Kobayashi et al. | |
| 2015/0221156 | A1* | 8/2015 | Xu | G07D 11/0006 194/206 |

FOREIGN PATENT DOCUMENTS

| | | |
|---|---|---|
| DE | 36 35 976 | 12/1990 |
| DE | 602 19 414 | 12/2007 |
| DE | 10 2009 021 320 | 11/2010 |
| DE | 10 2010 004 581 | 7/2011 |
| DE | 10 2010 004 577 | 9/2011 |
| EP | 0 620 942 | 3/1996 |
| EP | 2 722 827 | 4/2014 |
| WO | 2007/090899 | 8/2007 |
| WO | 2011/150961 | 12/2011 |

OTHER PUBLICATIONS

European Search Report of Jan. 23, 2015, 14175768.2 (5 pages).

* cited by examiner

*Primary Examiner* — Mark Beauchaine
(74) *Attorney, Agent, or Firm* — Gerald E. Hespos; Michael J. Porco; Matthew T. Hespos

(57) ABSTRACT

A cash box (10) has a housing (12) and a base tray (16) arranged within the housing. The base tray (16) delimits a receiving area (28) for receiving a value note stack (22). The base tray (16) is movable relative to the housing (12) between a removal position and a retracted position.

15 Claims, 5 Drawing Sheets

CASH BOX HAVING A MOVABLE BASE TRAY

BACKGROUND

1. Field of the Invention

The invention relates to a cash box comprising a housing and a base tray arranged within the housing. The base tray delimits a receiving area for receiving a value note stack at least in part, wherein the notes of value of a received value note stack stand with their edges on a bottom element of the base tray.

2. Description of the Related Art

Known cash boxes have a housing in which a receiving area is provided in which notes of value in the form of a value note stack are received and stand with their edges, in particular their longer edges, on the bottom of the cash box. An opening for the automatic feeding and/or removing of notes of value via separating and/or feeding modules is provided in the housing of the cash box. The opening is closable by a shutter. Such known cash boxes usually have a retracting flap that separates the receiving area from the opening. The retracting flap is adjustable between a swiveled-on position and a swiveled-off position, wherein, in the swiveled-on position, it keeps the notes of value of the value note stack away from the opening and no feeding and removing of notes of value is possible. Thus, the retracting flap is arranged in the swiveled-on position when the shutter is closed and the cash box is not received in an automated teller machine or other devices for handling notes of value. In contrast thereto, the retracting flap is arranged in the swiveled-off position when the cash box is inserted in a device for handling notes of value and the shutter is open so that the notes of value can be removed through the opening.

When the cash box is again removed from the automated teller machine, then the retracting flap is again moved from the swiveled-off position into the swiveled-on position before or during the closing of the shutter, as a result whereof the received value note stack is moved further into the box so that notes of value are no longer arranged in the feeding and removing area.

What is problematic is that in doing so the notes of value have to be moved relative to the bottom of the cash box on which they stand. Depending on the specific structure of the retracting flap it may happen that notes of value are jammed, notes of value are not removed from the shutter area and/or notes of value are pulled under the value note stack. This results in that during the later removal and/or the feeding, errors may occur and, in the worst case, the cash box has to be taken out of service and manually emptied and newly filled.

Such cash boxes with pivotable retracting flaps are, for example, known from documents DE 10 2010 004 581 A1, DE 10 2010 004 577 A1, DE 10 2009 021 320 A1 and DE 602 19 414 T2.

From document DE 36 35 976 T2, a cash box is known in which the receiving area in which the notes of value are received is delimited by a press-on carriage, a retaining element and support elements.

It is an object of the invention to provide a cash box that guarantees a safe feeding and/or removal of notes of value.

SUMMARY OF THE INVENTION

According to the invention, the base tray is designed and mounted such that it is movable relative to the housing of the cash box between a removal position and a retracted position.

As a result, it is achieved that the notes of value, for example during the removal of the cash box from an automated teller machine, do not have to be moved relative to the bottom element on which they stand with their edges. Thus, it is in turn prevented that the notes of value can inadvertently be pulled under the value note stack, get jammed or remain in the removal area and that errors may occur as a result thereof. Thus, a particularly easy and safe movement of the value note stack between the position which it has to assume for the removal of the notes of value and the position in which it is arranged when the cash box is transported is achieved.

The base tray may be designed such that, when moving the base tray, the position of the received notes of value relative to the base tray remains unchanged.

The base tray may be mounted relative to the housing linearly movably along the housing. As a result, an easy movement of the base tray is achieved.

An adjusting unit may be provided by means of which the base tray can be moved relative to the housing between the retracted position and the removal position. This adjusting unit can, for example, be designed in the form of a drive unit.

The base tray may be mounted to the housing via rails so that an easy displacement is possible.

The cash box may have an opening for the automatic feeding and/or removing of notes of value. In addition to this opening, the cash box can also have a further opening through which the notes of value can be manually fed and/or removed. This opening is in particular closable via a cover.

The opening for the automatic feeding and/or removing of notes of value may be closable via a shutter that can be moved between an open and a closed position.

The base tray may be moved relative to the housing such that a front side of the base tray facing the opening for the automatic feeding and/or removing of notes of value has a smaller distance to the opening in the removal position than in the retracted position. As a result, it is achieved that in the removal position of the base tray the notes of value can be removed from the base tray and thus from the cash box. In the retracted position, on the other hand, the base tray is arranged further away from the opening so that the shutter can be closed and no notes of value are present in the closing area.

The base tray may be arranged in the removal position when the shutter is arranged in the open position, and is arranged in the retracted position when the shutter is arranged in the closed position.

The shutter and the base tray may be coupled to each other such that when the shutter is opened the base tray is automatically moved from the retracted position into the removal position, and/or when the shutter is closed the base tray is automatically moved from the removal position into the retracted position. As a result, it is achieved that the movement of the base tray takes place automatically when the shutter is opened and closed and thus cannot be forgotten. In addition, it is not necessary to provide an own drive unit for moving the base tray or an own mechanism for moving the base tray since the shutter is usually designed such that when the cash box is inserted into a device for handling notes of value the shutter is automatically opened via an engagement with an engagement element provided for this and, vice versa, is again closed via this engagement when the cash box is removed.

The bottom element of the base tray may be plate-shaped so that the notes of value of the value note stack can stand on it over a surface as large as possible. Thus a jamming of the notes of value on the base tray is prevented.

The base tray may have a front wall on the side facing the opening of the cash box for the automatic feeding and/or removing of notes of value, which front wall delimits the receiving area in the direction of the opening. By means of this front wall it is achieved that a retracting flap against which the notes of value are pressed in known cash boxes can be dispensed with.

The front wall may be stationary relative to the bottom element of the base tray, i.e. that the position of these two elements to each other is not changed. Thus, the notes of value also are moved when the base tray is moved between the removal and the retracted position without having to move relative to the bottom element of the base tray on which they stand.

The front wall and the bottom element may be arranged to each other at an angle of 90° so that a safe reception of the notes of value without a jamming is possible.

The cash box may comprise a press-on unit that presses the value note stack against the front wall so that this stack is always kept under a required minimum pressure and a falling over of the notes of value is prevented. The press-on unit can be connected to the front wall by means of an elastic element via which the press-on unit is biased in the direction of the front wall. Alternatively, any other type of press-on units known from cash boxes can be used.

Here, the press-on unit presses the value note stack against the front wall so that the note of value arranged at the front side of the value note stack contacts with its front or rear side, preferably completely, the front wall. Thus, the value note stack is safely pressed on.

The base tray may additionally have two side walls for the lateral delimitation of the receiving area, which side walls delimit the receiving area in the direction of the side walls of the cash box housing at least in part, preferably completely. By means of these side walls, the stability of the base tray is additionally increased. In particular, by means of the complete one-piece design of the base tray composed of the bottom element, the front wall and/or the side walls a particularly stable and cost-efficient structure can be achieved which is easy to produce. Further, by means of the side walls the advantage is achieved that the notes of value, in particular during insertion and removal, cannot slip laterally. As a result, it is prevented that during the value note removal notes of value are pulled off in a non-straight manner.

The side walls may be arranged both orthogonally to the bottom element as well as orthogonally to the front wall so that by means of the front wall, the side walls, the bottom element and the press-on unit a cuboid-shaped receiving area for receiving the value note stack is delimited.

The front wall may have at least one recess through which a pull-off element of a separating module projects. When the cash box is inserted in a device for handling notes of value, such as an automated teller machine, an automatic cash register system, and/or an automatic cash safe, then the shutter is opened during insertion. The device for handling notes of value has a separating module via which the notes of value received in the cash box can be removed from the receiving area. This has the advantage that not each and every cash box requires an own separating mechanism but this only has to be provided in the automated teller machines. The separating module has pull-off elements which contact the notes of value through the corresponding recess in the front wall of the base tray when the base tray is arranged in the removal position. These pull-off elements can in particular be rolls which, when rotated, move the notes of value in a predetermined direction, in particular downward, out of the base tray and thus also out of the cash box.

The front wall may have more than one recess, in particular three recesses, through which one separating element each, preferably one roll each, can project. As a result, it is achieved that the note of value arranged at the front side of the received value note stack is uniformly contacted over its entire width and thus can be safely removed.

An opening, in particular a slot, may be provided between the bottom element and the front wall of the base tray, through which slot the notes of value can be pulled downward out of the cash box. In particular, the notes of value may be moved through this opening by a corresponding rotation of the separating elements and then transported away from the cash box via further transport elements.

The press-on unit may be designed such that they press the value note stack so strongly against the front wall that the notes of value cannot slip through the opening by themselves but are only transported through the opening between the front wall and the bottom element when they are forced to do so by the pull-off elements of the separating unit. As a result, it is achieved that the notes of value cannot slip out of the receiving area by themselves but this will only happen when a removal is intended and is performed automatically. According to an alternative embodiment of the invention, also a closing element can be provided which closes the opening between the front wall and the bottom element at least when the base tray is not arranged in the removal position so that a slipping of notes of value through the opening is prevented.

Further features and advantages of the invention result from the following description which explains the invention in more detail on the basis of embodiments in connection with the enclosed Figures.

BRIEF DESCRIPTION OF THE DRAWINGS

Figure 1:
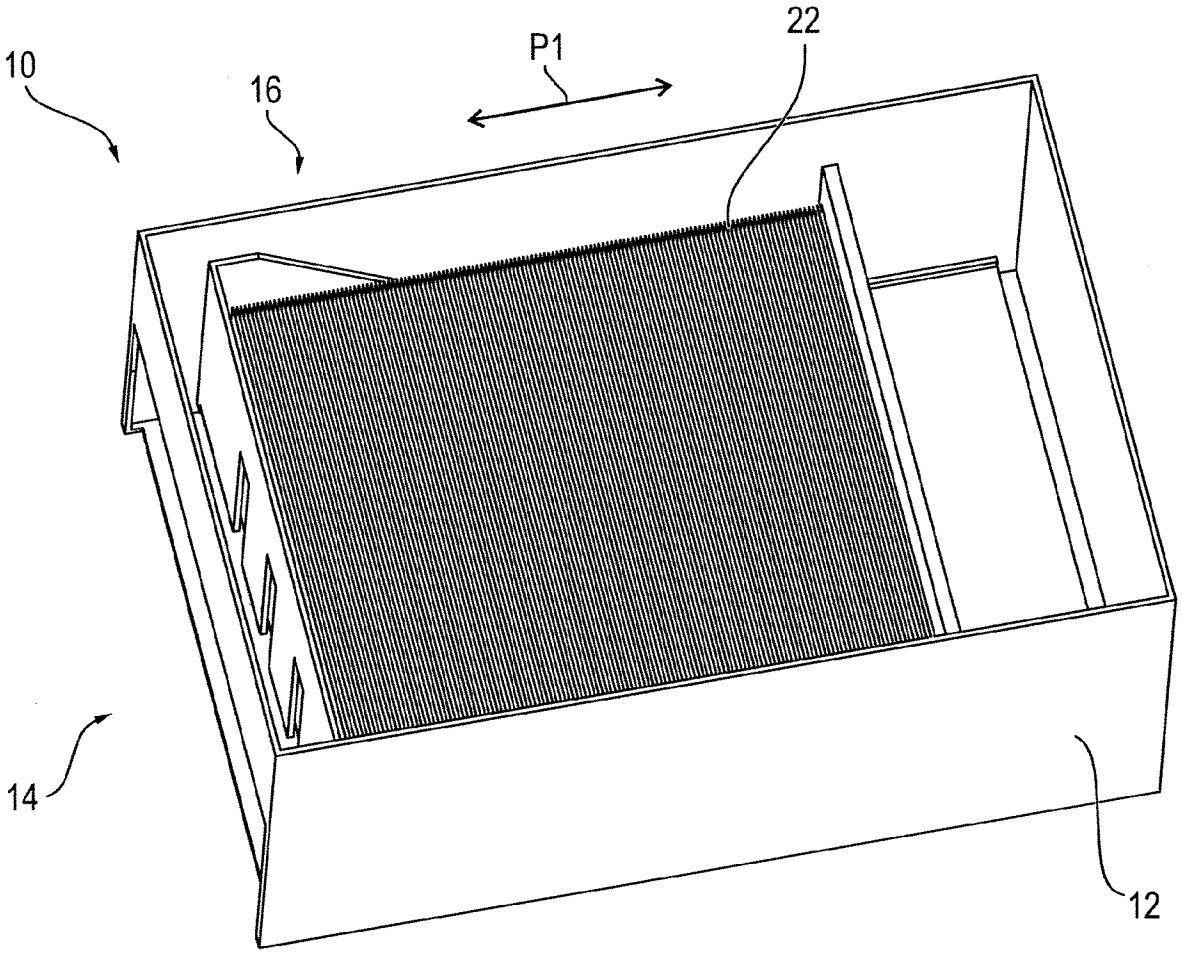
FIG. 1 shows a schematic perspective illustration of a cash box.

In FIG. 1, a schematic perspective highly simplified illustration of a cash box 10 is illustrated. The cash box 10 is used for the transport of notes of value between cash centers, automated teller machines, automatic cash register systems and other devices for handling notes of value.

The cash box 10 has a housing 12, of which in FIG. 1 a cover is not illustrated so that the inner component parts of the cash box 10 are better visible. In the housing 12, an opening 14 is provided through which the notes of value can be automatically fed and/or removed. When the cash box 10 is inserted into an automated teller machine, notes of value can be removed from the inside the cash box 10 via the opening 14 by means of a separating module of the automated teller machine.

During transport, i.e. when the cash box 10 is not inserted in an automated teller machine or other devices for the removal of notes of value, the opening 14 is closed via a non-illustrated closing unit, a so-called shutter. When inserted into an automated teller machine, an engagement element of the insertion compartment engages with a recess of the shutter and thus moves the latter automatically from a closed into an open position. In contrast, the shutter is automatically closed again when the cash box 10 is removed.

For removing the notes of value, these have to be arranged in close vicinity to the opening 14 so that these can be seized and removed by the separating module. So that the shutter, however, can be closed in an unimpeded manner, no notes of value will be jammed and, during opening of the shutter, no notes of value will fall out, the notes of value have to be arranged in a retracted position in which they have a predetermined distance to the opening 14 during transport.

Figure 2:
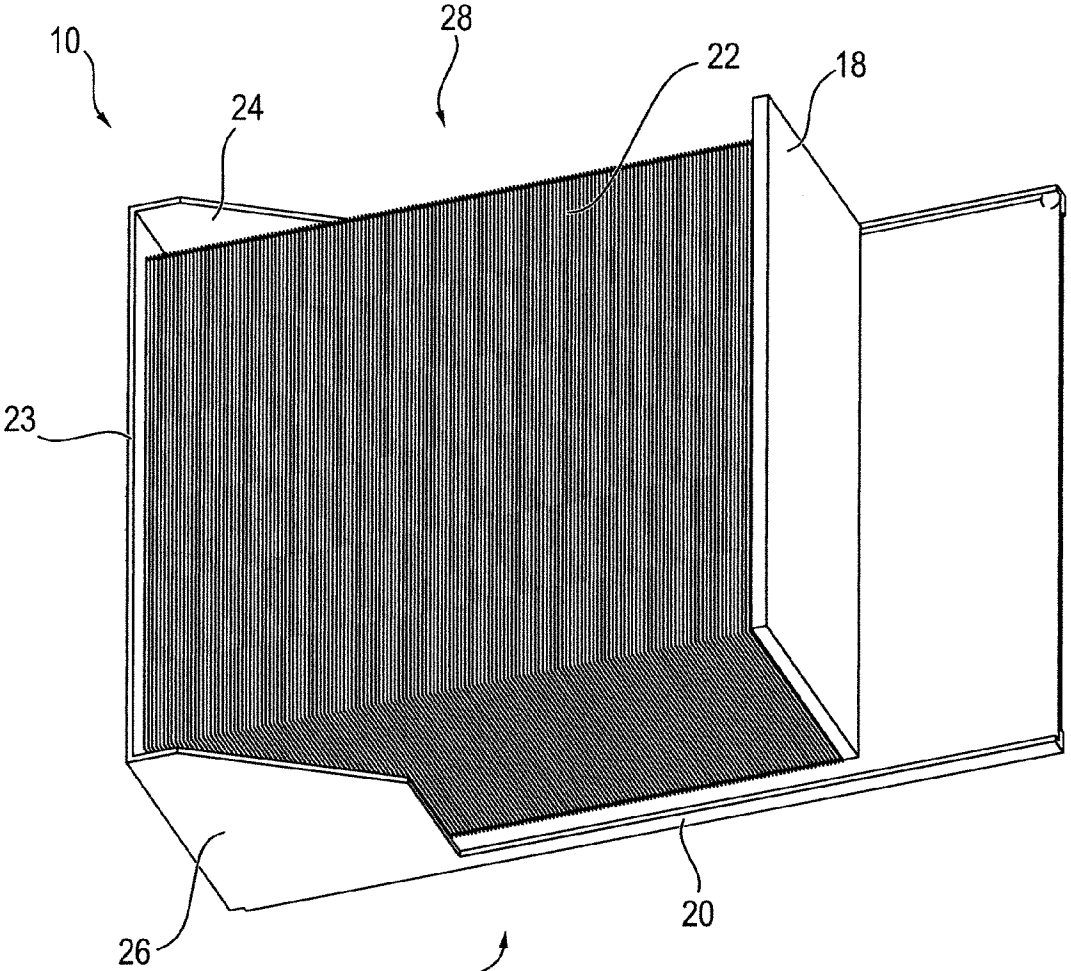
FIG. 2 shows a schematic perspective illustration of a base tray, a value note stack and a press-on unit of the cash box according to FIG. 1.
Figure 3:
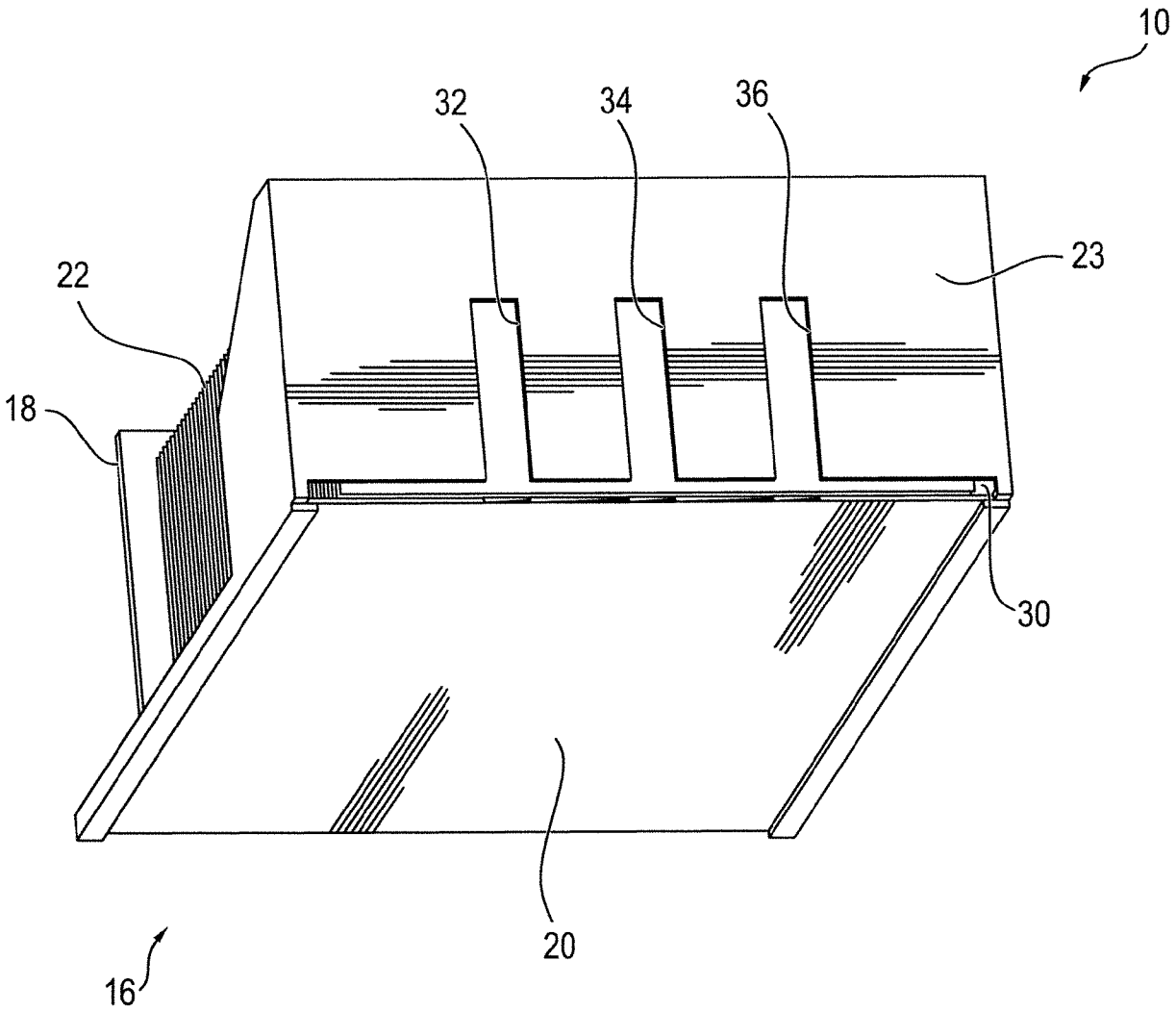
FIG. 3 shows a further schematic perspective illustration of the base tray, the press-on unit and the value note stack according to FIG. 2.

According to the invention, this is solved by a movable base tray 16 that will still be described in more detail in the following and that is movable relative to the housing 12 of the cash box 10 in the direction of the double arrow P1 between the removal and the retracted position. In FIGS. 2 and 3, each time a schematic perspective illustration of this base tray and a press-on unit 18 of the cash box 10 is shown.

The base tray 16 has a bottom element 20 on which the notes of value of the value note stack 22 stand with their edges. Further, the base tray 16 has a front wall 23 against which the value note stack 22 is pressed by means of the press-on unit 18. As a result, the notes of value always are kept under a required pressure and thus a falling over of the notes of value of the value note stack 22 is prevented.

The press-on unit 18 can be biased in the direction of the front wall 23 in particular by means of an elastic element so that it always moves together with the value note stack 22 and presses it reliably against the front wall 23 depending on the filling level of the cash box 10, i.e. depending on how many notes of value are comprised by the value note stack 22.

Further, the base tray 16 comprises two side walls 24, 26 by means of which the receiving area 28 within which the value note stack 22 is received is laterally delimited at least in part. The side walls 24, 26 are in particular arranged orthogonally to the front wall 23 and likewise orthogonally to the bottom element 20. Likewise, the front wall 23 and the bottom element 20 are preferably orthogonal relative to each other.

Between the front wall 23 and the bottom element 20, a slot 30 is provided through which the notes of value of the value note stack 22 to be removed can be removed individually from the receiving area 28. The press-on unit 18 is here designed such that it presses the value note stack 22 so strongly against the front wall 23 that the notes of value arranged at the front side of the value note stack 22 cannot slip through the slot 30 by themselves. The notes of value can only be pulled off by means of the separating module. For this, three recesses 32 to 36 are provided in the front wall, through which, as will still be described in more detail in connection with FIGS. 4 and 5, pull-off elements 40 of the separating module can project and thus contact the note of value arranged at the front side of the value note stack 22. By means of a corresponding force transmission this note of value is removed through the slot 30 and can thus be processed further in the device for handling notes of value in which the cash box 10 is inserted.

In an alternative embodiment of the invention, also more or less than three recesses 32 to 36, for example only two recesses 32 to 36 or four recesses 32 to 36 can be provided. Likewise, it is alternatively possible that the cash box 10 comprises a closing element by means of which the slot 30 is closable at least when the base tray 16 is arranged in the retracted position.

Figure 4:
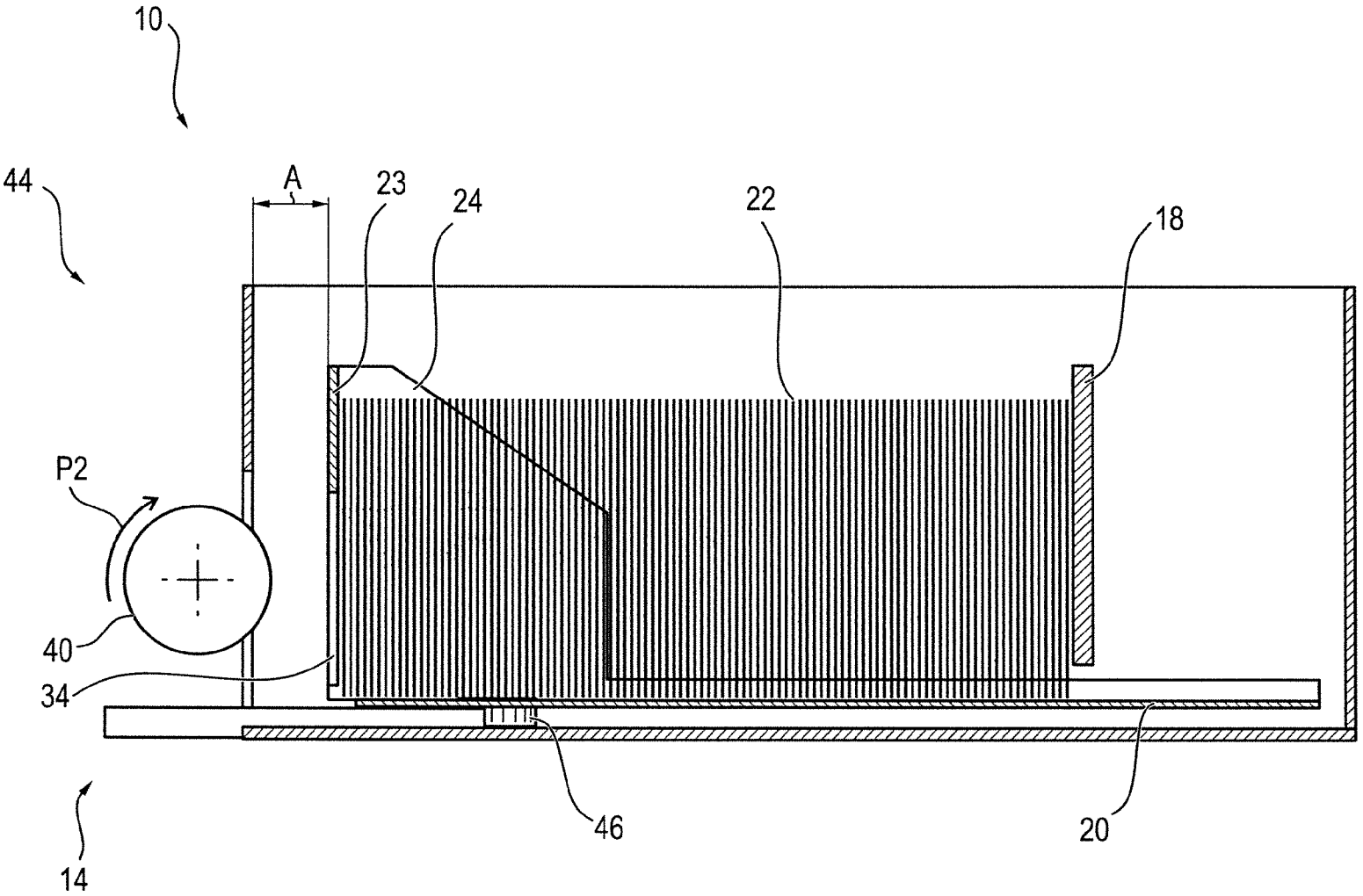
FIG. 4 shows a sectional illustration of the cash box according to FIG. 1, with the base tray being arranged in a retracted position.
Figure 5:
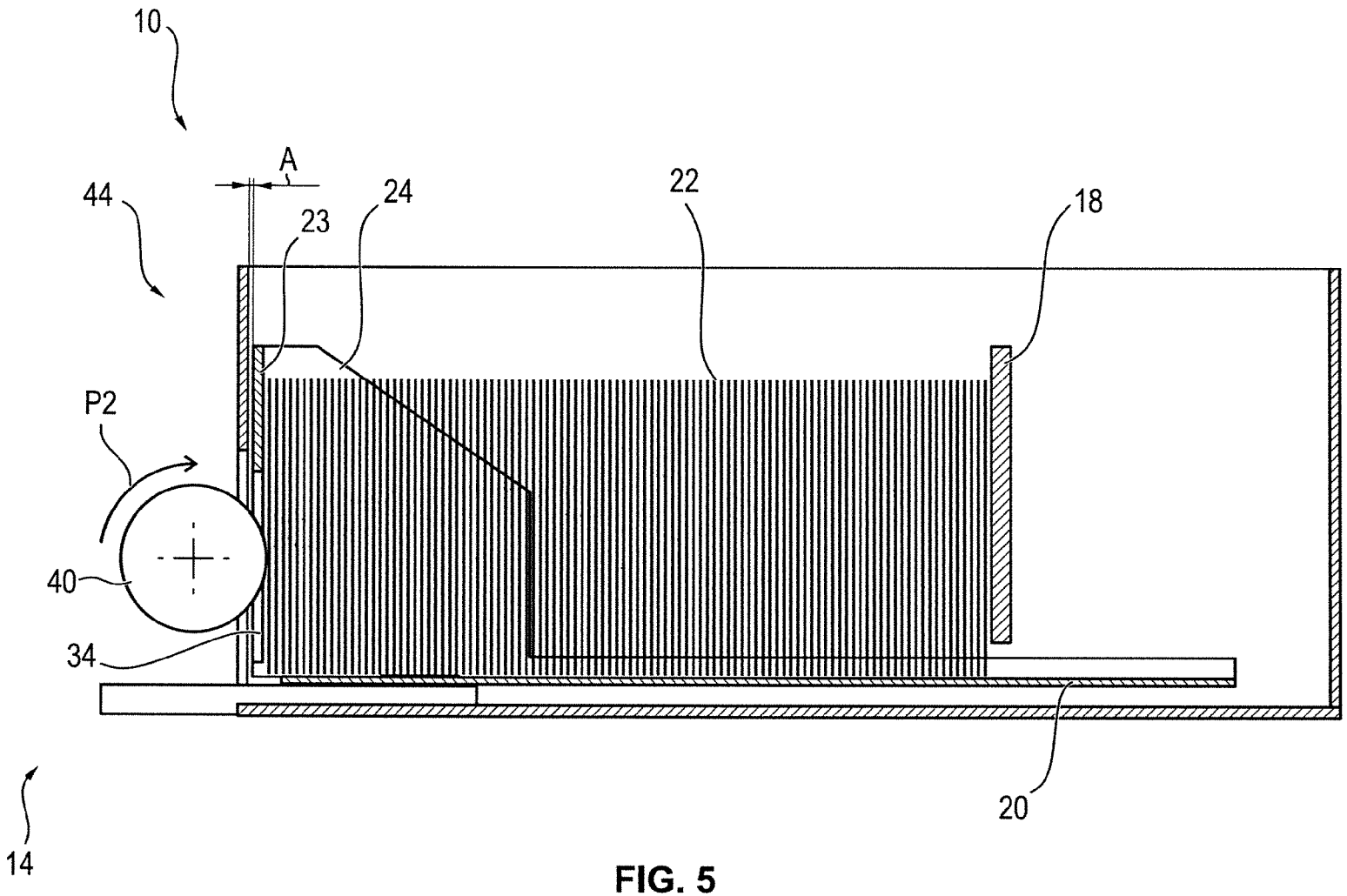
FIG. 5 shows a sectional illustration of the cash box according to FIG. 1, with the base tray being arranged in a removal position.

In FIGS. 4 and 5, each time a sectional illustration of the cash box 10 is shown, wherein in FIG. 4 the retracted position of the base tray 16 and in FIG. 5 the removal position is illustrated.

In FIGS. 4 and 5, further each time the pull-off elements 40 of a separating module are illustrated which are designed in this case in the form of rolls that are rotatable in the direction of the arrow P2 for the pull-off of the notes of value. In the retracted position shown in FIG. 4, the base tray 16 and thus also the value note stack 22 received therein have a predetermined distance A to the front side 44 of the cash box 10 and thus to the opening 14 of the cash box 10.

By means of a merely schematically indicated adjusting unit 46 of the cash box 10 the base tray 16 can be moved from the retracted position into a removal position shown in FIG. 5, in which it has a substantially smaller distance to the front side 44 of the cash box 10 and thus to the opening 14.

This adjusting unit 46 can, for example, be designed in the form of a motor. Alternatively, the adjustment can also be accomplished by a passive adjusting unit, for example in that there is a coupling with the shutter so that when the shutter is opened the base tray 16 is automatically moved from the retracted position into the removal position. In contrast, the base tray 16 is automatically moved from the removal into the retracted position when the shutter is closed.

In the removal position shown in FIG. 5, the base tray is arranged such that the pull-off elements 40 can project through the recesses 32 to 36 and thus contact the note of value arranged on the front side of the value note stack 22 and remove it through the slot 30.

Compared to known retracting flaps, the provision of such a base tray 16 has the advantage that when the value note stack 22 is moved between the removal and the retracted position the value note stack 22 itself does not have to be moved relative to the bottom 20 on which it stands. This has the advantage that the notes of value are not pulled under the value note stack 22 and/or get stuck during movement. As a result, a particular safe function is achieved and the occurrence of errors is prevented.

LIST OF REFERENCE SIGNS

10 cash box
12 housing
14 opening
16 base tray
18 press-on unit
20 bottom element
22 value note stack
23 front wall
24, 26 side wall
28 receiving area
30 slot
32, 34, 36 recess

40 pull-off element
44 front side
46 adjusting unit
P1, P2 direction
A distance

What is claimed is:

1. A cash box, comprising:

a housing (12) and a base tray (16) arranged within the housing (12), the base tray (16) delimiting a receiving area (28) for receiving a value note stack (22) at least in part, so that the notes of value of the received value note stack (22) stand with edges of the notes on a bottom element (28) of the base tray (16), the base tray (16) being movable relative to the housing (12) between a removal position and a retracted position, wherein the base tray (16) has a front wall (23) at its front side facing an opening (14) of the cash box (10) for automatic feeding and/or removing of the notes of value, the front wall delimiting the receiving area (28) in a direction of the opening (14).

2. The cash box (10) of claim 1, wherein the base tray (16) is designed such that when the base tray (16) is moved the position of the received notes of value relative to the base tray (16) remains unchanged.

3. The cash box (10) of claim 1, wherein the base tray (16) is mounted relative to the housing (12) linearly movably along the housing (12).

4. The cash box (10) of claim 1, wherein the cash box (10) has an adjusting unit (46) for moving the base tray (16) between the retracted position and the removal position.

5. The cash box (10) of claim 1, wherein the cash box (10) has an opening (14) for automatic feeding and/or removing of notes of value, and wherein a front side of the base tray (16) facing this opening (14) has a smaller distance (A) to the opening (14) in the removal position as compared to the retracted position.

6. The cash box (10) of claim 1, wherein the bottom element (20) of the base tray (16) is plate-shaped.

7. The cash box (10) of claim 1, wherein a press-on unit (18) is provided and is configured to press the value note stack (22) against the front wall (23) so that the note of value arranged at a front side of the value note stack (22) has a front or rear side that contacts the front wall (23).

8. The cash box (10) of claim 1, wherein the bottom element (20) and the front wall (23) are stationary relative to each other and orthogonal to each other.

9. The cash box (10) of claim 1, wherein the base tray (16) comprises two side walls (24, 26) for laterally delimiting the receiving area (28), the side walls being orthogonal to the bottom element (20) and/or to the front wall (23).

10. The cash box (10) of claim 1, wherein the front wall (23) has at least one recess (32 to 36) for the passage of a pull-off element (40) of a separating module when the cash box (10) is inserted in a device for handling notes of value and the base tray (16) is arranged in the removal position.

11. The cash box (10) of claim 1, further comprising a slot between the bottom element (20) and the front wall (23) for passing notes of value.

12. The cash box (10) of claim 11, wherein the press-on unit (18) is designed to press the value note stack (22) so strongly against the front wall (23) that the notes of value of the value note stack (22) do not slip through the opening (30) by themselves.

13. A cash box (10), comprising:

a housing (12) having an opening (14) for automatic feeding and/or removing of notes of value; and a base tray (16) arranged within the housing (12), the base tray (16) delimiting a receiving area (28) for receiving a value note stack (22) at least in part, so that the notes of value of the received value note stack (22) stand with edges of the notes on a bottom element (20) of the base tray (16), the base tray (16) being movable relative to the housing (12) between a removal position and a retracted position, a front side of the base tray (16) facing the opening (14) having a smaller distance (A) to the opening (14) in the removal position as compared to the retracted position, and wherein the cash box (10) has a shutter for closing the opening (14) and the base tray (16) is arranged in the removal position when the shutter is open and is arranged in the retracted position when the shutter is closed.

14. The cash box (10) of claim 13, wherein the shutter and the base tray are coupled to each other so that when the shutter is opened the base tray (16) is moved automatically from the retracted position into the removal position and/or when the shutter is closed the base tray (16) is moved automatically from the removal position into the retracted position.

15. The cash box (10) of claim 13, wherein the base tray (16) has a front wall (23) at its front side facing an opening (14) of the cash box (10) for the automatic feeding and/or removing, the front wall delimiting the receiving area (28) in a direction of the opening (14).

* * * * *